US005814435A

United States Patent [19]

Kojima et al.

[11] Patent Number: 5,814,435

[45] Date of Patent: Sep. 29, 1998

[54] PHOTOGRAPHIC COMPOSITION HAVING FIXING CAPACITY AND A METHOD FOR PROCESSING USING THE SAME

[75] Inventors: Tetsuro Kojima; Masaru Yoshikawa; Yoshihiro Fujita, all of Minami-ashigara, Japan

[73] Assignee: Fuji Photo Film Co., Ltd., Kanagawa-ken, Japan

[21] Appl. No.: 692,118

[22] Filed: Aug. 5, 1996

Related U.S. Application Data

[63] Continuation-in-part of Ser. No. 365,113, Dec. 28, 1994, abandoned.

[30] Foreign Application Priority Data

Dec. 28, 1993 [JP] Japan ..... 5-350531

[51] Int. Cl.[6] ..... G03C 7/42

[52] U.S. Cl. ..... 430/393; 430/419; 430/453; 430/455; 430/456; 430/459; 430/460

[58] Field of Search ..... 430/393, 419, 430/453, 455, 456, 459, 460

[56] References Cited

U.S. PATENT DOCUMENTS

| | | | |
|---|---|---|---|
| 3,950,404 | 4/1976 | Filby et al. | 562/125 |
| 5,120,635 | 6/1992 | Sasaki et al. | 430/455 |
| 5,543,272 | 8/1996 | Kojima et al. | 430/455 |

FOREIGN PATENT DOCUMENTS

| | | | |
|---|---|---|---|
| 611990 | 8/1994 | European Pat. Off. | 430/455 |

*Primary Examiner*—Hoa Van Le
*Attorney, Agent, or Firm*—Birch, Stewart, Kolasch & Birch, LLP

[57] ABSTRACT

There is disclosed a photographic composition having fixing capacity and a method for processing a silver halide photographic material using the same. The photographic composition having fixing capacity comprises at least one compound represented by the following formula (I):

$RSO_2M$ formula (I)

wherein R represents a lower alkyl group having 1 to 3 carbon atoms, and M represents a hydrogen atom or a cationic group.

28 Claims, No Drawings

PHOTOGRAPHIC COMPOSITION HAVING FIXING CAPACITY AND A METHOD FOR PROCESSING USING THE SAME

This application is a continuation-in-part of application Ser. No. 08/365,113 filed on Dec. 28, 1994, now abandoned.

FIELD OF THE INVENTION

The present invention relates to a method for processing a silver halide photographic material, more particularly to a method for processing a silver halide photographic material wherein even when low-replenishment-rate processing is carried out, the fixing of the photographic material is not retarded.

BACKGROUND OF THE INVENTION

The processing of silver halide color photographic materials generally comprises a color-developing process and a desilvering process. The silver produced in the development is oxidized with a bleaching agent and then is dissolved by the action of a fixing agent. As the bleaching agent, a ferric (III) ion complex salt (e.g., an aminopolycarboxylic acid/ferric (III) complex salt) is used mainly. As the fixing agent a thiosulfate is generally used.

On the other hand, the processing of black-and-white photographic materials comprises a developing process and a process for removing the unexposed silver halide. It differs from the processing of color photographic materials in that the black-and-white photographic material is subjected to the fixing process without being subjected to a bleaching process after the development. Also in this case, as the fixing agent, generally a thiosulfate is used.

In recent years, reduction of the replenisher volume of photographic processing solutions has been vigorously studied. This is also true for the bath having fixing capacity. As low-replenishment-rate processing proceeds, the amounts of silver ions and halide ions (e.g., iodide ions, bromide ions, and chloride ions) that accumulate in the running exhausted solution increase, resulting in the slowing of fixing. This is a serious problem. Therefore a solution composition is desired with which, even when low-replenishment-rate processing is effected, the fixing is not delayed.

Further, the stability of solutions becomes a problem because of the elongation of retention time at the low-replenishment-rate processing. In particular, thiosulfates that are used widely as fixing agents have a problem of sulfur-deposit. Therefore, the improvement of this problem is highly desired.

To improve the above-described problem, conventionally thiocyanate ions (e.g., ammonium thiocyanate and sodium thiocyanate) are added into a fixing solution. However, the delay in the fixing is not satisfactorily improved and there is concern about the influence of thiocyanate ions on the environment. Therefore, more effective materials are desired.

SUMMARY OF THE INVENTION

Therefore, the first object of the present invention is to provide a method for processing a silver halide photographic material, wherein, even when low-replenishment-rate processing is carried out, the fixing is not delayed.

The second object of the present invention is to provide a method for processing a silver halide photographic material, wherein, even when low-replenishment-rate processing is carried out, the stability of solution is excellent, and precipitates do not occur.

The above and other objects, features, and advantages of the invention will be apparent more fully from the following description.

DETAILED DESCRIPTION OF THE INVENTION

The above object has been achieved by the following photographic composition having fixing capacity and a method for processing a silver halide photographic material using the same:

(1) A photographic composition having fixing capacity, which comprises at least one compound represented by the following formula (I):

$$RSO_2M \qquad \text{formula (I)}$$

wherein R represents a lower alkyl group having 1 to 3 carbon atoms and M represents a hydrogen atom or a cationic group.

(2) A method for processing a silver halide photographic material, wherein, after a silver halide photographic material having at least one photosensitive silver halide emulsion layer on a support is exposed to light, the silver halide photographic material is subjected to development processing, which comprises processing in a bath having fixing capacity which contains at least one compound represented by the formula (I) as stated in the above (1).

(3) The method for processing a silver halide photographic material as stated in the above (2), wherein the bath having fixing capacity contains at least one compound represented by the above formula (I) in an amount of 0.01 mol/liter or more.

(4) The method for processing a silver halide photographic material as stated in the above (2), wherein the bath having fixing capacity contains thiosulfate ions and further at least one compound represented by the above formula (I).

(5) The method for processing a silver halide photographic material as stated in the above (2), wherein the bath having fixing capacity contains thiosulfate ions in an amount of 0.1 mol/liter or more and at least one compound represented by the above formula (I) in an amount of 0.01 mol/liter or more.

(6) The method for processing a silver halide photographic material as stated in the above (2), wherein the processing is carried out under replenishing of a solution having fixing capacity.

Formulae (I) of the present invention will now be described in detail below.

In formula (I), R represents a lower alkyl group having 1 to 3 carbon atoms. Concrete examples of R include, for example, methyl group, ethyl group, propyl group, isopropyl group, methoxymethyl group, methoxyethyl group, carboxymethyl group, carboxyethyl group, aminomethyl group, acetamidomethyl group, sulfonamido-methyl group, carbamoylmethyl group, and sulfamoylmethyl group.

The groups represented by R in formula (I) may be substituted. Examples of the substituent are the following: a halogen atom (e.g., fluorine, chlorine, and bromine), an alkoxy group (e.g., methoxy and ethoxy), an amino group (e.g., unsubstituted amino and methylamino), an acylamino group (e.g., acetylamino), a ureido group (e.g., unsubstituted ureido and N-methylureido), a urethane group (e.g., methoxycarbonylamino), a sulfonylamino group (e.g., methylsulfonylamino), a sulfamoyl group (e.g., unsubstituted sulfamoyl and N-methylsulfamoyl), a carbamoyl group (e.g., unsubstituted carbamoyl and N-methylcarbamoyl), a sulfonyl group (e.g., methanesulfonyl), an alkyloxycarbonyl group (e.g., methoxycarbonyl), an acyl group (e.g., acetyl), an acyloxy group (e.g., acetoxy), a phosphoric acid amido group (e.g., N,N-dimethylphosphoric acid amide), an alkylthio group (e.g., methylthio and ethylthio), a cyano group, a sulfo group, a carboxyl group, a mercapto group, a phosphono group, a nitro group, and a hydrazino group.

The cation group represented by M in formula (I) includes, for example, an alkali metal ion (e.g., a sodium ion, a potassium ion, a lithium ion, and a cesium ion), an alkali earth metal ion (e.g., a calcium ion and a magnesium ion), an ammonium group (e.g., unsubstituted ammonium and methylammonium), and a guanidinium group.

In formula (I), preferably, R represents a methyl group or an ethyl group, and M represents a hydrogen atom, an alkali metal ion, or an ammonium group.

In formula (I), more preferably, R represents a methyl group, and M represents a sodium ion, a potassium ion, or an unsubstituted ammonium group.

Specific examples of the compounds represented by formula (I) of the present invention are shown below, but the present invention is not limited to them.

1. $CH_3SO_2NH_4$
2. $CH_3SO_2Na$
3. $CH_3SO_2K$
4. $CH_3SO_2Li$
5. $C_2H_5SO_2NH_4$
6. $C_2H_5SO_2Na$
7. $C_2H_5SO_2K$
8. $C_3H_7SO_2NH_4$
9. $C_3H_7SO_2Na$

10. 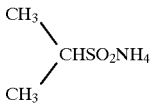

11. 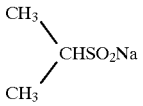

12. $CH_3OCH_2SO_2NH_4$
13. $CH_3OCH_2SO_2Na$
14. $CH_3OCH_2CH_2SO_2Na$
15. $CH_3OCH_2CH_2SO_2NH_4$
16. $HOOCCH_2SO_2H$
17. $NaOOCCH_2SO_2Na$
18. $HOOCCH_2CH_2SO_2K$
19. $H_2NCH_2SO_2H$
20. $H_2NCH_2SO_2NH_4$
21. $CH_3CONHCH_2SO_2NH_4$
22. $CH_3CONHCH_2SO_2Na$
23. $CH_3SO_2NHCH_2SO_2Na$
24. $CH_3SO_2NHCH_2SO_2NH_4$
25. $CH_3SO_2CH_2SO_2Na$
26. $H_2NCOCH_2S0_2NH_4$
27. $H_2NCOCH_2CH_2SO_2Na$
28. $H_2NSO_2CH_2S0_2NH_4$
29. $H_2NSO_2CH_2SO_2Na$
30. $F_3CSO_2Na$
31. $F_3CSO_2NH_4$
32. $F_3CSO_2K$
33. $C_2F_3SO_2NH_4$
34. $ClCH_2CH_2SO_2NH_4$

35. $H_2N\overset{\overset{\displaystyle O}{\|}}{C}NHCH_2SO_2Na$

36. $NCCH_2SO_2Na$

The compound represented by formula (I) can be synthesized, generally, by reduction of sulfonyl chloride compound, and as a reducing reagent can be used such as zinc dust, sulfite ion, or alkali metal sulfide. Further some other methods are known. As a common synthesis method can be mentioned, for example, those described in *Chem. Rev.*, 48, 69 (1951), *Organic Synthesis, Collective Vol. I*, 492 (1941), *J. Am. Chem. Soc.*, 72, 1215 (1950), and ibid. 50, 792,274 (1928).

As "a bath having fixing capacity" in the present invention, can be mentioned, for example, a fixing bath or a bleach-fix bath, and various combinations are possible in accordance with the processing process. As a photographic composition having fixing capacity in the present invention can be mentioned, for example, one for use in the fixing bath such as a fixing solution or one for use in the bleach-fix bath such as a bleach-fix solution. When the compound represented by formula (I) is used in combination with a usual fixing agent, its performances can be exhibited remarkably.

Amounts of compounds represented by formula (I) of the present invention for use in fixing bath or bleach-fix bath are preferably $1\times10^{-3}$ to 5 mol, more preferably $1\times10^{-2}$ to 3 mol, and particularly preferably $1\times10^{-1}$ to 2 mol, per liter of the fixing solution or bleach-fix solution.

Addition of compounds represented by formula (I) into the washing bath or stabilizing bath is effective to prevent the occurrence of precipitate in the washing bath. Herein, the concentration of compounds represented by formula (I) in these baths is preferably $10^{-3}$ to 0.5 times the concentration of them in the preceding bath.

When the compound represented by formula (I) of the present invention is used in combination with other fixing agents, as a fixing agent for the combined use, a thiosulfate, such as sodium thiosulfate, ammonium thiosulfate, ammonium sodium thiosulfate and potassium thiosulfate; a thiocyanate (rhodanate), such as sodium thiocyanate, ammonium thiocyanate and potassium thiocyanate; a thiourea compound; a thioether compound; a mercapto compound; and a metho-ionic compound can be mentioned, with preference given to a thiosulfate. Preferably the amount of the thiosulfate to be added is 0.1 to 3 mol, more preferably 0.5 to 1.5 mol, per liter of the fixing solution.

When the compound represented by formula (I) of the present invention is used in combination with a thiosulfate, preferably the amount of the compound of the present invention to be added is 0.01 to 3 mol, more preferably 0.05 to 1 mol, and most preferably 0.1 to 0.5 mol, per liter of the fixing solution. If the amount to be added is too small, the fixing-facilitating effect and the stabilizing effect for solution becomes small, while if the amount is too large, deposition is liable to occur during the storage of the fixing solution at a low temperature.

When the compound represented by formula (I) of the present invention is used in combination with a thiosulfate, the improvement in the fixing performance and the improvement in the solution stability are conspicuous. These improvements are conspicuous, particularly when low-replenishment-rate processing is carried out, even if silver ions and halide ions (particularly iodide ions) accumulate.

If the additionally used fixing agent is sodium thiosulfate, M in formula (I) is preferably a sodium ion. On the other hand, if the additionally used fixing agent is ammonium thiosulfate, M in the formula (I) is preferably an unsubstituted ammonium group.

The composition having fixing capacity of the present invention may be supplied in the form of solution or in the form of powder. When it is supplied in the form of solution, it may be a use solution or a condensed solution.

Now, processing solutions that can be used preferably mainly for the processing of color photographic materials are described.

The photographic emulsion layer after being color-developed is generally subjected to a bleaching process. The bleaching process may be carried out at the same time as a fixing process (bleach-fix process) or separately. Further, to intend the rapidness of processing, a processing process can be effected wherein the bleach-fix process is carried out after bleaching process. Further, processing in two continuous bleach-fix baths, fixing process before bleach-fix processing, or bleaching processing after bleach-fix process may be carried out arbitrarily depending on the purpose.

As the bleaching agent to be contained as a major component of the bleaching solution or the bleach-fix solution of the present invention, can be mentioned inorganic compounds, such as red prussiate, ferric chloride, chromates, persulfates, and bromates and partially organic compounds, such as aminopolycarboxylic acid ferric complex salts and aminopolyphosphoric acid ferric complex salts.

In the present invention, in view, for example, of the environmental protection, the handling safety, and corrosion of metals, aminopolycarboxylic acid ferric complex salts are preferably used.

Specific examples of aminopolycarboxylic acid ferric complex salts are given below, but the present invention is not restricted to them. The oxidation-reduction potentials are also given additionally.

| No. | Compound | Oxidation-reduction potential (mV vs. NHE, pH = 6) |
|---|---|---|
| 1. | N-(2-acetamide)iminodiacetic acid ferric complex salt | 180 |
| 2. | methyliminodiacetic acid ferric complex salt | 200 |
| 3. | iminodiacetic acid ferric complex salt | 210 |
| 4. | 1,4-butylenediaminetetraacetic acid ferric complex salt | 230 |
| 5. | diethylene thioether diaminetetraacetic acid ferric complex salt | 230 |
| 6. | glycol ether diaminetetraacetic acid ferric complex salt | 240 |
| 7. | 1,3-propylenediaminetetraacetic acid ferric complex salt | 250 |
| 8. | ethylenediaminetetraacetic acid ferric complex salt | 110 |
| 9. | diethylenetriaminepentaacetic acid ferric complex salt | 80 |
| 10. | trans-1,2-cyclohexadiaminetetra-acetic acid ferric complex salt | 80 |

The oxidation-reduction potentials of the above bleaching agents are defined as those measured by the method described in *Transactions of the Faraday Society*, Vol. 55 (1959), pp 1312 to 1313.

In the present invention, in view of the rapid processing and with a view to allowing the effect of the present invention to being exhibited effectively, it is preferable to use a bleaching agent having an oxidation-reduction potential of 150 mV or over, more preferably 180 mV or over, and most preferably 200 mV or over. If the oxidation-reduction potential is too high, since bleach fogging will occur, the upper limit is 700 mV or below, preferably 500 mV or below.

Among these, Compound No. 7, that is, 1,3-propylenediaminetetraacetic acid ferric complex salt, is particularly preferable.

The aminopolycarboxylic acid ferric complex salt is used, for example, in the form of sodium salt, potassium salt, or ammonium salt, and the ammonium salt is preferable because the bleaching speed is highest.

The amount of the bleaching agent to be used in the bleaching solution is preferably 0.17 to 0.7 mol per liter of the bleaching solution. With a view to making the processing rapid and with a view to reducing stain that will be formed with time, preferably the amount of the bleaching agent to be used in the bleaching solution is 0.25 to 0.7 mol, particularly preferably 0.30 to 0.6 mol, per liter of the bleaching solution. The amount of the bleaching agent to be used in the bleach-fix solution is 0.01 to 0.5 mol, preferably 0.02 to 0.2 mol. per liter of the bleach-fix solution.

Further in the present invention, the bleaching agents (oxidizing agent) may be used alone or as a mixture of two or more. If two or more bleaching agents are used in combination, it is suggested that the combined concentration falls within the above concentration.

Incidentally, if an aminopolycarboxylic acid ferric complex salt is used in the bleaching solution or the bleach-fix solution, although it can be used in the form of the above complex salt, a complex salt may be formed in the processing solution by allowing an aminopolycarboxylic acid that will form a complex forming compound to be present with a ferric salt (e.g., ferric sulfate, ferric chloride, ferric nitrate, ammonium ferric sulfate, and ferric phosphate).

In this case wherein a complex is formed, the aminopolycarboxylic acid may be added in slightly excess over the required amount for the formation of the complex with the ferric ions. When it is added in excess, it is added in an amount of 0.01 to 10% excess, preferably.

Generally, the above bleaching solution is used at a pH of 2 to 7.0. With a view of making the processing rapid, preferably the bleaching solution is used at a pH of 2.5 to 5.0, more preferably 3.0 to 4.8, and particularly preferably 3.5 to 4.5, and preferably the replenisher is used at a pH of 2.0 to 4.2.

In the present invention, in order to adjust the pH to the above range, it is possible to use a known acid.

Preferably such an acid is an acid having a pKa of 2 to 5.5. In the present invention, pKa indicates the logarithmic value of the reciprocal of the acid dissociation constant and is the value obtained at an ionic strength of 0.1 mol/dm and at 25° C.

It is preferable that an acid having a pKa of 2.0 to 5.5 is contained in the bleaching solution in an amount of 0.5 mol/liter or more, because bleach fogging can be prevented and precipitation from the replenisher with time at a low temperature can be prevented.

The acid having a pKa of 2.0 to 5.5 may be any of inorganic acids, such as phosphoric acid, and organic acids, such as acetic acid, malonic acid, and citric acid, with particular preference given to an organic acid having a carboxylic group(s).

The organic acid having a pKa of 2.0 to 5.5 may be a monobasic acid or polybasic acid. In the case of a polybasic acid, it can be used in the form of a metal salt (e.g., a sodium salt or a potassium salt) or an ammonium salt if its pKa is in the above range of 2.0 to 5.5. Further, organic acids having a pKa of 2.0 to 5.5 may be used as a mixture of two or more.

Preferable specific examples of organic acids having a pKa of 2.0 to 5.5 that can be used in the present invention are various organic acids, for example, an aliphatic monobasic acid, such as acetic acid, monochloroacetic acid, glycolic acid, propionic acid, lactic acid, glycolic acid, acrylic acid, butyric acid, isobutyric acid, pivalic acid, and aminobutyric acid; an amino acid-series compound, such as asparagine, alanine, arginine, ethionine, glycine, glutamine, cysteine, serine, methionine, and leucine; an aromatic monobasic acid, such as benzoic acid, monosubstituted benzoic acid, for example, chlorobenzoic acid, and hydroxybenzoic acid, and nicotinic acid; an aliphatic dibasic acid, such as oxalic acid, malonic acid, succinic acid, tartaric acid, malic acid, maleic acid, fumaric acid, oxaloacetic acid, glutaric acid, and adipic acid; an amino acid-series dibasic acid, such as asparagic acid, glutamic acid, and cystine; an aromatic dibasic acid, such as phthalic acid and terephthalic acid; and a polybasic acid, such as citric acid.

Among these, dibasic acids having carboxyl groups is preferred, with particular preference given to succinic acid, maleic acid, and glutaric acid.

The amount of these organic acids to be used is 0.2 to 2 mol, preferably 0.4 to 1.0 mol, per liter of the bleaching solution. These acids are preferable because they allow the effect of the present invention to be exhibited more noticeably, are free of any smell, and inhibit bleach fogging.

The total amount of these acids to be used is suitably 0.3 mol or more, preferably 0.4 to 2.0 mol, and more preferably 0.5 to 1.0 mol, per liter of the bleaching solution.

When the pH of the bleaching solution is adjusted to the above range, the above acid can be used in combination with an alkaline chemical (e.g., aqueous ammonia, KOH, NaOH, imidazole, monoethanolamine, and diethanolamine). Particularly preferably the acid may be used in combination with aqueous ammonia.

As an alkaline chemical to be used for a bleach starter when the start solution of the bleaching solution is adjusted from the replenisher, potassium carbonate, aqueous ammonia, imidazole, monoethanolamine, and diethanolamine are preferably used. Without using a bleach starter, the replenisher may be diluted to be used.

To the bleaching solution, bleach-fix solution or its preceding bath for use in the present invention, various bleaching accelerators can be added. For such bleaching accelerators, for example, compounds having a mercapto group or a disulfide group described in U.S. Pat. No. 3,893,858, German Patent No. 1,290,821, British Patent No. 1,138,842, JP-A ("JP-A" means unexamined published Japanese patent application) No. 95630/1978, and Research Disclosure No. 17129 (July, 1978), thiazolidine derivatives described in JP-A No. 140129/1975, thiourea derivatives described in U.S. Pat. No. 3,706,561, iodides described in JP-A No. 16235/1983, polyethylene oxides described in German Patent No. 2,748,430, and polyamine compounds described in JP-B ("JP-B" means examined Japanese patent publication) No. 8836/1970 can be used. Particularly preferably, mercapto compounds as described in British Patent No. 1,138,842 and JP-A No. 190856/1990 are preferred.

In the bleaching solution or bleach-fix solution for use in the present invention, in addition to the bleaching agent and the above compounds, a rehalogenizing agent, e.g., a bromide, such as potassium bromide, sodium bromide, and ammonium bromide; and a chloride, such as potassium chloride, sodium chloride, and ammonium chloride can be contained. The concentration of the rehalogenizing agent is 0.1 to 5.0 mol, preferably 0.5 to 3.0 mol, per liter of the processing solution.

Further, it is preferable to use ammonium nitrate as a metal corrosion inhibitor.

In the present invention, preferably a replenishing system is used, and the replenishment rate of the bleaching solution or bleach-fix solution is preferably 600 ml or less, more preferably 100 to 500 ml, per $m^2$ of the photographic material.

The processing time of bleaching or bleach-fix is 120 sec or less, preferably 50 sec or less, and more preferably 40 sec or less.

In the processing, preferably the bleaching solution wherein an aminopolycarboxylic acid ferric complex salt is used is aerated to oxidize the produced aminopolycarboxylic acid iron (II) complex salt. Thus, the bleaching agent (oxidizing agent) is regenerated and the photographic properties can be kept quite stably.

For the processing solutions for use in respective processes in the present invention, preferably water is supplied to compensate the evaporated water to carry out so-called evaporation correction.

As a specified method for replenishing water, although there is no restriction in particular, the method as described in JP-A Nos. 254959/1989 and 254960/1989, wherein the evaporated amount of water is determined from a monitor water bath provided besides the bleaching bath, from which amount the evaporated amount of water in the bleaching bath is calculated, and the corresponding amount of water is replenished, and the evaporation correction method using a water-level sensor and overflow sensor, as described in JP-A Nos. 248155/1991, 249644/1991, 249645/1991, 249646/1991, and 14042/1992, are preferable.

To the solution having fixing capacity, can be added, as a preservative, sulfites (e.g., sodium sulfite, potassium sulfite, and ammonium sulfite), hydroxylamines and hydrazines. However, it is not preferred to incorporate some of the bisulfite addition reacting compounds disclosed in U.S. Pat. No. 5,120,635 (Sasaki et al), the entire contents of which are herein incorporated by reference. Specifically, Sasaki et al teaches incorporating a compound of Formula (A), (B), (C) or (D) (compound capable of addition reacting with a bisulfite) into a photographic processing solution having a fixing ability.

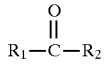

(A)

wherein $R_1$ represents a hydrogen atom, a substituted or unsubstituted alkyl group (e.g., methyl, ethyl, methoxyethyl, carboxymethyl, sulfomethyl, sulfoethyl), a substituted or unsubstituted alkenyl group (e.g., allyl), a substituted or unsubstituted aralkyl group (e.g., benzyl, phenethyl, 4-methoxybenzyl, 4-sulfobenzyl), a substituted or unsubstituted cycloalkyl group (cyclohexyl), a substituted or unsubstituted aryl group (e.g., phenyl, naphthyl, 3-sulfobutoxyphenyl, 4-N-methyl-N-sulfopropylaminophenyl, 3-sulfopropylphenyl, 3-carboxyphenyl), a substituted or unsubstituted heterocyclic group (e.g., pyridyl, thienyl, pyrrolyl, indolyl, furyl, furfuryl, morpholinyl, imidazolyl), a carboxyl group or a salt thereof, a substituted or unsubstituted ester group (e.g., methoxycarbonyl, ethoxycarbonyl), a substituted or unsubstituted acyl group (e.g., acetyl, methoxypropionyl), or a substituted or unsubstituted carbamoyl group (e.g., carbamoyl, dimethylcarbamoyl); $R_2$ represents a hydrogen atom, a substituted or unsubstituted alkyl group, a substituted or unsubstituted alkenyl group, a substituted or unsubstituted aralkyl group, a substituted or unsubstituted cycloalkyl group, a substituted or unsubstituted aryl group, or a substituted or unsubstituted heterocyclic group; or $R_1$ and $R_2$ can combine to form a ring.

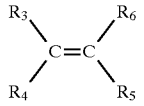

(B)

wherein $R_3$, $R_4$, and $R_5$ each represents a hydrogen atom, a substituted or unsubstituted alkyl group, a substituted or unsubstituted alkenyl group, a substituted or unsubstituted aralkyl group, a substituted or unsubstituted cycloalkyl group, a substituted or unsubstituted aryl group, a substituted or unsubstituted heterocyclic group, a carboxyl group or a salt thereof, a substituted or unsubstituted ester group, a substituted or unsubstituted acyl group, a halogen atom (e.g., chlorine), a substituted or unsubstituted ether group (e.g., methoxy, phenoxy), a sulfo group or a salt thereof, a substituted or unsubstituted sulfinyl group (e.g., methanesulfinyl), a substituted or unsubstituted sulfonyl group (e.g., methanesulfonyl, benzenesulfonyl, 4-methylbenzenesulfonyl), a cyano group, a nitro group, a substituted or unsubstituted carbamoyl group, or a substituted or unsubstituted sulfamoyl group (e.g., sulfamoyl, dimethylsulfamoyl); and $R_6$ represents an electron attracting group; or $R_3$ and $R_4$, $R_4$ and $R_5$, $R_5$ and $R_6$, or $R_6$ and $R_3$ can combine to form a ring. With a proviso that when at least one of $R_3$, $R_4$, $R_5$ and $R_6$ is an acyl group, $R_4$ and $R_5$ or $R_6$ and $R_3$ does not form a ring. The total numbers of carbon atoms in each $R_3$, $R_4$, $R_5$ and $R_6$ are preferably 20 or less and more preferably 10 or less. $R_6$ preferably represents a nitro group, a cyano group, a substituted or unsubstituted acyl group, or a substituted or unsubstituted ester group.

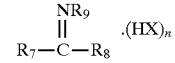

(C)

wherein $R_7$, $R_8$, and $R_9$ each represents a hydrogen atom, a substituted or unsubstituted alkyl group, a substituted or unsubstituted alkenyl group, a substituted or unsubstituted cycloalkyl group, a substituted or unsubstituted aralkyl group, a substituted or unsubstituted aryl group, a substituted or unsubstituted heterocyclic group, a substituted or unsubstituted amino group (e.g., amino, dimethylamino, carboxymethylamino), a carboxyl group or a salt thereof, a substituted or unsubstituted ester group, a substituted or unsubstituted acyl group, a substituted or unsubstituted ether group, a hydroxyl group, or a substituted or unsubstituted thioether group (e.g., methylthio, methylthiomethylthio) ; X represents an anion; and n represents 0 or 1; or $R_7$ and $R_8$, $R_8$ and $R_9$, or $R_9$ and $R_7$ can combine to form a ring.

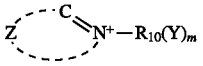

(D)

wherein $R_{10}$ represents a substituted or unsubstituted alkyl group (e.g., methyl, ethyl, sulfoethyl, sulfobutyl, sulfopropyl, carboxymethyl, dimethylaminoethyl, 2,2,2-trifluoroethyl), a substituted or unsubstituted alkenyl group (e.g., allyl), a substituted or unsubstituted aralkyl group (e.g., benzyl, phenethyl), a substituted or unsubstituted cycloalkyl group (e.g., cyclohexyl), a substituted or unsubstituted aryl group (e.g., phenyl, naphthyl, 4-methoxyphenyl, 3-sulfopropylphenyl), or a substituted or unsubstituted heterocyclic group (e.g., pyridyl, pyrazolyl, imidazolyl); Z represents a heterocyclic group comprising at least one of a carbon atom, a nitrogen atom, an oxygen atom, a sulfur atom or a selenium atom; Y represents an anion; and m represents 0 or 1; or $R_{10}$ can combine with an atom in the Z ring and form a ring.

In formula (D), the heterocyclic group represented by Z can be a substituted or unsubstituted 5 or 6-membered ring composed of at least one of a carbon atom and a nitrogen atom and an oxygen atom, a sulfur atom, and a selenium atom (e.g., pyridinium, imidazolium, quinolinium, oxazolium, thiazolium, benzimidazolium). The anion as represented by Y includes a chloride ion, a bromide ion, and a p-toluenesulfonate ion.

The presence of a compound according to one of formulae (A)–(D) can interfere with the superior results that are achieved by a photographic composition having a fixing capacity that contains a compound of present formula (I). Accordingly, one embodiment of the present invention is a composition having a fixing capacity and containing a compound represented by formula (I) of the present invention, with the proviso that the composition does not contain a compound according to formula (A), (B), (C) or (D); and to a method for processing a silver halide photographic material using the same.

Further additives which can be included in the solution having fixing capacity include various fluorescent brightening agents, anti-foaming agents, or surface-active agents, polyvinyl pyrrolidones, and organic solvents, such as methanol.

For the purpose of stabilizing the processing solutions, preferably, a chelating agent, such as various aminopolycarboxylic acids and organic phosphonic acids, is added to the solution having fixing capacity. As preferable chelating agents, aminopolycarboxylic acids can be mentioned such as nitrilotriacetic acid, hydroxyethyl-iminodiacetic acid, nitrilomonoacetic dipropionic acid, ethylenediaminetetraacetic acid, diethylenetriaminepenta-acetic acid, cyclohexanediaminetetraacetic acid, 1,2-propylenediaminetetraacetic acid, ethylenediaminedisuccinic acid, and 1,3-propylenediaminedisuccinic acid. The amount of the chelating agent to be added is 0.01 to 0.3 mol, preferably 0.03 to 0.2 mol, per liter of the processing solution.

Although the bleach-fix solution (start solution) at the time of start of the processing is prepared by dissolving in water the above-mentioned compound that can be used in a bleach-fix solution, the said bleach-fix solution can be prepared by mixing suitable amounts of a bleaching solution and a fixing solution that are separately prepared.

The pH of the fixing solution for color photosensitive materials is preferably 5 to 9, more preferably 7 to 8. The pH of the bleach-fix solution is preferably 6 to 8.5, more preferably 6.5 to 8.0.

In order to adjust the pH of the fixing solution and the bleach-fix solution to such ranges, as a buffer, a compound having a pKa in the range of 6.0 to 9.0 is preferably contained. Preferably such compounds are imidazoles, such as imidazole and 2-methylimidazole. Such compounds are used in an amount of 0.1 to 10 mol, preferably 0.2 to 3 mol, per liter of the processing solution.

If replenishment processing is carried out, the replenishment rate of the fixing solution is generally 2,000 ml or less, preferably 100 to 2,000 ml, more preferably 200 to 800 ml, and particularly preferably 300 to 600 ml, per $m^2$ of the photographic material. In this case, the replenishment rate is the replenisher volume containing fixing agent, but if an overflow solution, such as subsequent washing water, is introduced into the bath having fixing capacity, the replenishment rate includes the amount of that overflow solution. The smaller the replenishment rate is, the more remarkable the effect of the present invention becomes.

In addition to the replenishing of the fixing replenisher to the fixing solution, the washing water or stabilizing solution of the subsequent bath is preferably introduced to the fixing solution. In this case, part or all of the overflow solution of the subsequent processing bath may be introduced to the bath having fixing capacity, or the processing solution in the processing bath may be directly pumped into the bath having fixing capacity.

In the present invention, the total processing time by-the fixing solution is 0.5 to 4 min, preferably 0.5 to 2 min, and particularly preferably 0.5 to 1 min.

In the present invention, the total processing time of the desilvering step, including bleaching, bleach-fix, and fixing is preferably 45 sec to 4 min, more preferably 1 to 2 min. The processing temperature is 25° to 50° C., preferably 35° to 45° C.

From the solution having fixing capacity of the present invention, silver can be recovered in a known manner, and the regenerated solution thus obtained by recovering silver can be reused. As the method for recovering silver, for example, an electrolysis method (described in French Patent No. 2,299,667), precipitation methods (described in JP-A No. 73037/1977 and German Patent No. 2,331,220), ion exchange methods (described in JP-A No. 17114/1976 and German Patent No. 2,548,237), and a metal substitution method (described in British Patent No. 1,353,805) are effective. These silver-recovering methods are preferably carried out from the tank solution in an in-line manner, since the rapid processability is further improved.

After the processing step with the solution having fixing capacity, generally, a washing processing step is-carried out. After the processing with the solution having fixing capacity, a simple processing method can be used wherein stabilizing processing that uses a stabilizing solution is carried out without carrying out washing substantially.

In order to prevent the processed photosensitive material from having water stains at the time of drying, the washing water used in the washing step can contain various surface-active agents. These surface-active agents include polyethylene glycol-type nonionic surface-active agents, polyhydric alcohol-type nonionic surface-active agents, alkylbenzene sulfonate-type anionic surface-active agents, higher-alcohol sulfate-type anionic surface-active agents, alkylnaphthalene sulfonate-type anionic surface-active agents, quaternary ammonium salt-type cationic surface-active agents, amine salt-type cationic surface-active agents, amino salt-type amphoteric surface-active agents, and betaine-type amphoteric surface-active agents, with preference given to nonionic surface-active agents, and more preference given to alkyl phenol ethylene oxide adducts. As the alkyl phenol, octylphenol, nonylphenol, dodecylphenol, and dinonylphenol are preferable and the number of the added ethylene oxide molecules is particularly preferably 8 to 14. Further, it is also preferable to use a silicon type surface-active agent high in defoaming action.

In the washing water, various bacteriaproofing agents and mildewproofing agents can be contained in order to prevent incrustation from forming or to prevent mildew from propagating on the processed photosensitive material. As examples of the bacteriaproofing agents and the mildewproofing agents, can be mentioned thiazolylbenzo-imidazole compounds as disclosed in JP-A Nos. 157244/1982 and 105145/1983, isothiazolone compounds as disclosed in JP-A No. 8542/1982, chlorophenol compounds, typically trichlorophenol, bromophenol compounds, organotin and organozinc compounds, acid amide compounds, diazine and triazine compounds, thiourea compounds, benzotriazole compounds, alkylguanidine compounds, quaternary ammonium compounds, typically benzalkonium chloride, antibiotics, typically penicillin, and general-purpose mildewproofing agents described in *J. Antibact. Antifung. Agents*, Vol. 1, No. 5, pp 207 to 223 (1983), which can be used as a mixture of two or more. Further, various bactericides described in JP-A No. 83820/1973 can also be used.

Among these compounds, particularly isothiazolone compounds are preferable, and further, among them, 1,2-benzisothiazoline-3-one is preferable. The amount of this compound to be added is 10 to 500 mg per liter of washing water or stabilizing solution.

In the washing water, various chelating agents are contained preferably. As preferable chelating agents, can be mentioned aminopolycarboxylic acids, such as ethylenediaminetetraacetic acid, diethylenetriaminepenta-acetic acid; organic phosphonic acids, such as 1-hydroxy-ethylidene-1, 1-diphosphonic acid and diethylenetriamine-N,N,N', N'-tetra-methylenephosphonic acid; or hydrolyzates of maleic anhydride polymers described in European Patent No. 345172A1.

Preferably the above-mentioned preservative that can be contained in the fixing solution and the bleach-fix solution is contained in the washing water.

The washing step and the stabilizing step are preferably of a multistage counter-current type, and the number of stages is preferably 2 to 4. The replenishment rate is 1 to 50 times, preferably 2 to 30 times, and more preferably 2 to 15 times, the carried-over amount from the preceding bath per unit area.

As the water for use in these washing steps, tap water can be used, but preferably water that has been deionized with ion exchange resins, to bring the Ca and Mg ions to a concentration of 5 mg/liter or less, or water that has been sterilized, for example, with a halogen or an ultraviolet germicidal lamp, is preferably used.

As the water for supplementing the evaporated amount of the processing solutions, tap water can be used, but deionized water or sterilized water that is preferably used in the above washing step is desirable.

The replenishers of the present invention are adjusted to keep the performance constant by supplying, to the processing solutions, compounds, which have been decreased by the processing of the photosensitive material and due to their deterioration over time in the automatic processor, and by controlling the concentrations of compounds dissolved out from the photosensitive material by the processing. Therefore, the compounds that will be decreased are made to have concentrations higher than the concentrations in the processing solutions, and the latter compounds are made to have lower concentrations. Further, in the case of compounds whose concentrations are hardly changed by the processing or over time, the compounds are generally contained approximately in the same concentrations as those of the processing solutions .

All of the above comrpounds that can be added to the washing water can be contained in the stabilizing solution. Particularly preferably t he stabilizing solution contains various surface-active agents for preventing the processed photosensitive material from having water stains at the time of drying, and bacteriaproof ig agents, mildewproofing agents, fungicides, and chelating agents for preventing incrustation from forming or for preventing mildew from propergating on the processed photosensitive material. Further, pyrazole or pyrazole derivatives having no N-methylol group can also be added. Further, in addition to the compound of the present invention, compounds for stabilizing dye images, such as hexamethylenetetramine, hexamethylenetetramine derivatives, hexahydrotriazine, hexahydrotriazine derivatives, dimethylol urea, and organic acids, and pH buffers can be contained. Further, if necessary, ammonium compounds, such as ammonium chloride and ammonium sulfite, compounds of metals, such as Bi and Al compounds, fluorescent brightening agents, hardening agents, and alkanolamines described in U.S. Pat. No. 4,786,583 can be used.

The stabilizing solution for use in the final processing step has generally a pH in the range of 4 to 9, with preference given to the range of 6 to 8. If the stabilizing solution of the present invention is used in the final processing step, the replenishment rate is preferably 200 to 1,500 ml, particularly preferably 300 to 600 ml, per $m^2$ of the photosensitive material to be processed. If the stabilizing solution of the present invention is used in the final processing step, the processing temperature is preferably 30° to 45° C. The processing time is preferably 10 sec to 2 min, particularly preferably 15 to 30 sec.

Generally, after the silver halide color photographic material is exposed to light imagewise, it is color-developed if the photosensitive material is of a negative type or a direct positive type, or it is subjected to black-and-white development, reversal processing, etc. and is color-developed if the photosensitive material is of a reversal positive type.

The color developer that can be used in the present invention is an aqueous alkali solution containing as a major component an aromatic primary amine color developing agent.

Preferable color-developing agents are p-phenylenediamine derivatives. Typical examples are shown below, but the present invention is not limited to them:

D-1 N,N-diethyl-p-phenylenediamine

D-2 2-methyl-N,N-diethyl-p-phenylenediamine

D-3 4-[N-ethyl-N-(β-hydroxyethyl)amino]aniline

D-4 2-methyl-4-[N-ethyl-N-(β-hydroxyethyl)amino] aniline

D-6 4-amino-3-methyl-N-ethyl-N-[β-(methanesulfonamido)-ethyl]aniline

D-7 4-amino-3-methyl-N-ethyl-N-methoxyethylaniline

D-8 4-amino-3-methyl-N-ethyl-N-(4-hydroxybutyl) aniline

Out of the above p-phenylenediamine derivatives, D-4 and D-6 are particularly preferable.

Further, these p-phenylenediamine derivatives may be in the form of salts, such as sulfates, hydrochlorides, sulfites, and p-toluenesulfonates. Preferably the amount of the aromatic primary amine color developing agent to be used is 0.001 to 0.1 mol, more preferably 0.01 to 0.06 mol, per liter of the color developer.

To the color developer, can be added, if necessary, as a preservative, a sulfite, such as sodium sulfite, potassium sulfite, sodium bisulfite, potassium bisulfite, sodium metasulfite, and potassium metasulfite, or a carbonyl sulfurous acid adduct. A preferable amount of these preservatives to be added is 0.5 to 10 g, more preferably 1 to 5 g, per liter of the color developer.

As compounds that can directly preserve the above-mentioned aromatic primary amine color-developing agents, can be mentioned various hydroxylamines described in JP-A Nos. 5341/1988 and 106655/1988 (in particular, those compounds having a sulfo group or a carboxyl group are preferable), hydroxamic acids described in JP-A No. 43138/1988, hydrazides and hydrazines described in JP-A No. 146041/1988, phenols described in JP-A Nos. 44657/1988 and 58443/1988, α-hydroxyketones and α-aminoketones described in JP-A No. 44656/1988, and various saccharides described in JP-A No. 36244/1988. In combination with the above compounds, monoamines described, for example, in JP-A Nos. 4235/1988, 24254/1988, 21647/1988, 146040/1988, 27841/1988, and 25654/1988, diamines described, for example, in JP-A Nos. 30845/1988, 14640/1988, and 43139/1988, polyamines described in JP-A Nos. 21647/1988, 26655/1988, and 44655/1988, nitroxy radicals described in JP-A No. 53551/1988, alcohols described in JP-A No. 43140/1988 and 53549/1988, oximes described in JP-A No. 56654/1988, and tertiary amines described in JP-A No. 239447/1988 can be used.

As other preservatives, various metals described in JP-A Nos. 44148/1982 and 53749/1982, salicylic acids described in JP-A No. 180588/1984, alkanolamines described in JP-A No. 3582/1979, polyethyleneimines described in JP-A No. 94349/1981, and aromatic polyhydroxy compounds described in U.S. Pat. No. 3,746,544 can be contained if necessary. Particularly aromatic polyhydroxy compounds are preferably added.

The color developer for use in the present invention has preferably a pH of 9 to 12, more preferably a pH of 9 to 11.0.

To keep the above pH, various buffers are preferably used.

Specific examples of the buffer include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The amount of the buffer to be added is preferably 0.1 mol or more, particularly preferably 0.1 to 0.4 mol, per liter of the color developer.

In addition, in the color developer, preferably use is made of various chelating agents as precipitation-preventing agents for calcium and magnesium or for improving the stability of the color developer. As the chelating agent, organic acid compounds are preferable, such as aminopolycarboxylic acids, organic sulfonic acids, and phosphonocarboxylic acids.

Typical examples of them are diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamineorthohydroxy-phenylacetic acid, 2-phosphonobutane-1,2,4-tricarboxylic acid, 1-hydroxyethylidene-1,1-diphosphonic acid, and N,N'-bis (2-hydroxybenzyl)ethylenediamine-N,N'-diacetic acid. These chelating agents may be used as a mixture of two or more if desired. The amount of the chelating agent to be added is an amount enough to sequester metal ions in the color developer and is, for example, on the order of 0.1 to 10 g per liter of the color developer.

To the color developer, if necessary, an arbitrary development accelerator can be added. However, preferably the color developer of the present invention substantially does not contain benzyl alcohol in view of the pollution, the solution preparation, and the prevention of color contamination. Herein "substantially does not contain" means that the amount of benzyl alcohol is 2 ml or below per liter of the color developer or that preferably the benzyl alcohol is not contained at all.

As other development accelerators, thioether compounds described, for example, in JP-B Nos. 16088/1962, 5987/1962, 7826/1963, 12380/1969, and 9019/1970, and U.S. Pat. No. 3,818,247, p-phenylenediamine compounds described in JP-A Nos. 49829/1977 and 15554/1975, quaternary ammonium salts described, for example, in JP-A No. 137726/1975, JP-B No. 30074/1969, and JP-A Nos. 156826/1981 and 43429/1977, amine compounds described, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346, and polyalkylene oxides described, for example, in JP-B Nos. 16088/1962 and 25201/1967, U.S. Pat. No. 3,128,183, JP-B Nos. 11431/1966 and 23883/1967, and U.S. Pat. No. 3,532,501 as well as 1-phenyl-3-pyrazolidones and imidazoles can be added as required. The amount of the development accelerator to be added is on the order of 0.01 to 5 g per liter of the color developer.

In the present invention, if required, any antifoggant can be added. As the antifoggant, an alkali metal halide, such as sodium chloride, potassium chloride, and potassium iodide, and an organic antifoggant can be used. As typical examples of the organic antifoggant, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolyl-methyl-benzimidazole, indazole, hydroxyazaindolizine, and adenine, can be mentioned. The amount of the antifoggant to be added is on the order of 0.001 to 1 g per liter of the color developer.

The color developer for use in the present invention may contain a fluorescent brightening agent. As the fluorescent brightening agent, a 4,4'-diamino-2,2'-disulfostilbene compound is preferable. The amount of the fluorescent brightening agent to be added is 0 to 5 g, preferably 0.1 to 4 g, per liter of the color developer.

If necessary, various surface-active agents, such as an alkyl sulfonic acid, an aryl sulfonic acid, an aliphatic carboxyl acids, an aromatic carboxylic acid, can be added.

The color-developing replenisher contains the compounds that are to be contained in the color developer. The role of the color-developing replenisher is to keep the development performance constant by supplying, to the color developer, compounds, which have been decreased by the processing of the photosensitive material and by their deterioration over time in the automatic processor, and by controlling the concentrations of compounds dissolved out from the photosensitive material by the processing. Therefore, the former compounds are higher in concentration than that of the color development tank solution, and the latter compounds are lower in concentration than that of the color development tank solution. The former compounds include a color-developing agent and a preservative, and they are contained in the replenisher in an amount of 1.1 to 2 times the amount in the tank solution. The latter compounds include a development restrainer, typically a halide (e.g., potassium bromide), and they are contained in the replenisher in an amount of 0 to 0.6 times the amount in the tank solution. Although generally the concentration of the halide in the replenisher is 0.006 mol/liter or less, that is a requirement that the lower the replenishing rate is, the more decreased the concentration is, and in some cases the replenisher contains no halides.

Generally compounds whose concentrations are hardly changed by the processing or over time are contained approximately in the same concentration as that of the color development tank solution. Examples thereof are chelating agents and buffers.

Further, the pH of the color-developing replenisher is about 0.05 to 0.5 higher than that of the tank solution, in order to prevent the pH of the tank solution from being lowered by the processing. It is required that this difference of the pH is increased as the replenishment rate is decreased. The replenishment rate of the color developer is 300 ml or less, preferably 100 to 1,500 ml, per $m^2$ of the photosensitive material.

Suitably the processing temperature of the color-developing is 20° to 50° C., preferably 30° to 45° C. The processing time is suitably 20 sec to 5 min, preferably 30 sec to 3 min and 20 sec, and more preferably 1 min to 2 min and 30 sec.

The color-developing bath may be divided, if necessary, into two or more baths, and the color-developing replenisher may be supplied from the first bath or the last bath, to reduce the development time and to reduce the replenishment rate.

The processing method of the present invention can be preferably used for color reversal processing. The reversal processing includes black-and-white development; then, if required, reversal processing, and color development. The black-and-white developer for use in this case is the generally used so-called black-and-white first developer used for reversal processing of color photosensitive materials. The black-and-white developer can contain various well-known additives that are added to black-and-white developers for use in the processing solution of black-and-white silver halide photosensitive material.

As typical additives can be mentioned developing agents, such as 1-phenyl-3-pyrazolidone, metol, and hydroquinone; preservatives, such as sulfites; accelerators of an alkali, such as sodium hydroxide, sodium carbonate, and potassium carbonate; organic or inorganic inhibitors, such as potassium bromide, 2-methylbenzimidazole, and methylbenzthiazole; water softeners, such as polyphosphates; and development restrainers comprising a trace amount of an iodide and a mercapto compound.

When the processing is carried out by using the above black-and-white developer or color developer and an automatic processor, preferably the area (opened area) where the developer (a color developer and a black-and-white developer) is in contact with the air is as small as possible. For example, if the opened surface ratio is defined as the value obtained by dividing the open area ($cm^2$) by the volume ($cm^3$) of the developer, the opened surface ratio is preferably 0.01 ($cm^{-1}$) or less, more preferably 0.005 or less.

The developer can be used by regenerating it.

The term "regeneration" of the developer means that the activity of the used developer is increased by using an anion exchange resin or electrodialysis, or by adding a treatment agent called a regenerant, so that the developer may be used again.

In this case, the regeneration rate (the rate of the overflow solution in the replenishing solution) is preferably 50% or more, particularly preferably 70% or more.

In processing in which the developer is regenerated, the overflow solution of the developer is regenerated to be used as a replenishing solution.

As the method for the regeneration, an anion exchange resin is used preferably. As a particularly preferable composition of an anion exchange resin and a method for the regeneration of the resin, those described in *Diaion Manual* (*I*) (14th edition, 1986), published by Mitsubishi Chemical Industries, Ltd. can be mentioned. Among anion exchange resins, resins having compositions described in JP-A Nos. 952/1990 and 281152/1989 are preferable.

The conditioning bath to be used for the reversal processing can contain an aminopolycarboxylic acid chelating agent, such as ethylenediaminetetraacetic acid, diethylenetriaminepentaacetic acid, 1,3-diamino-propanetetraacetic acid, and cyclohexanediaminetetra-acetic acid, and various bleach accelerators that are described in the section for the bleaching solution, such as sulfites, for example, sodium sulfite and ammonium sulfite, thioglycerin, aminoethanethiol, and sulfoethanethiol. In order to prevent scum from forming, preferably sorbitan esters of fatty acids substituted by ethylene oxide described in U.S. Pat. No. 4,839,262 and polyoxyethylene compounds described in U.S. Pat. No. 4,059,444 and *Research Disclosure* (RD) Vol. 191, 19104 (1980) are contained. These compounds are used in an amount in the range of 0.1 to 20 g, preferably 1 to 5 g, per liter of the conditioner.

Preferably the conditioning bath contains an image stabilizing agent that can be used in the above-mentioned stabilizing solution so that may have a stabilizing effect.

The pH of the conditioning bath is generally in the range of 3 to 11, preferably 4 to 9, and more preferably 4.5 to 7.

The processing time of the conditioning bath is preferably 30 sec to 5 min.

The replenishment rate of the conditioning bath is preferably 30 to 3,000 ml, particularly preferably 50 to 1,500 ml, per $m^2$ of the photosensitive material.

The processing temperature of the conditioning bath is preferably 20° to 50° C., particularly preferably 30° to 40° C.

By introducing the over flow solution from the washing step or stabilizing step to the preceding bath having fixing capacity, the amount of waste solution can be reduced.

During processing, not only bleaching solution, bleach-fix solution, and fixing solution but also other processing solutions (e.g., color developer, washing water, and stabilizing solution) are preferably replenished with suitable amount of water, replenisher, or processing replenisher, in order to correct the concentration due to evaporation of water.

In the present invention, effects are attained particularly effective, when the total processing time with processing solutions between after bleaching step and before entering in drying step is 1 to 3 min, preferably 1 min and 20 sec to 2 min.

In the present invention, the drying temperature is preferably 50° to 65° C., more preferably 50° to 60° C.

The drying time is preferably 30 sec to 2 min, more preferably 40 to 80 sec.

Suitably the photosensitive material in the present invention is provided with at least one blue-sensitive silver halide emulsion layer, at least one green-sensitive silver halide emulsion layer, and at least one red-sensitive silver halide emulsion layer on a support. There is no particular restrictions on the number and order of the silver halide emulsion layers and the nonphotosensitive layers. A typical example is a silver halide color photographic material having on a support at least one photosensitive layer that comprises a plurality of silver halide emulsion layers whose color sensitivities are substantially identical but whose sensitivities are different. The photosensitive layer is a unit photosensitive layer having color sensitivity to any of blue light, green light, and red light. In a multilayer silver halide color photographic material, the arrangement of the unit photosensitive layers is generally such that a red-sensitive layer, a green-sensitive layer, and a blue-sensitive layer in the order stated from the support side are placed. However, the above order may be reversed according to the purpose and such an order is possible that layers having the same color sensitivity have a layer different in color sensitivity therefrom between them.

Nonphotosensitive layers such as various intermediate layers may be placed between, on top of, or under the above-mentioned silver halide photosensitive layers.

The intermediate layer may contain, for example, couplers or the like as described in JP-A Nos. 43748/1986, 113438/1984, 113440/1984, 20037/1986, and 20038/1986 and may also contain a color mixing. inhibitor, an ultraviolet absorbent, and a stain-inhibitor, as generally used.

Each of the silver halide emulsion layers constituting unit photosensitive layers respectively can preferably take a two-layer constitution comprising a high-sensitive emulsion layer and a low-sensitive emulsion layer as described in West Germany Patent No. 1,121,470 or British Patent No. 923,045. Generally, they are arranged preferably such that the sensitivities are decreased toward the support and each nonphotosensitive layer may be placed between the silver halide emulsion layers. As described, for example, in JP-A Nos. 112751/1982, 200350/1987, 206541/1987, and 206543/1987, a low-sensitive emulsion layer may be placed away from the support and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH stated from the side away from the support.

As described in JP-B No. 34932/1980, an order of a blue-sensitive layer/GH/RH/GL/RL stated from the side away from the support is also possible. Further, as described in JP-A Nos. 25738/1981 and 63936/1987, an order of a blue-sensitive layer/GL/RL/GH/RH stated from the side away from the support is also possible. Further, as described in JP-B No. 15495/1974, an arrangement is possible wherein the uppermost layer is a silver halide emulsion layer highest in sensitivity, the intermediate layer is a silver halide emulsion layer lower in sensitivity than that of the uppermost layer, the lower layer is a silver halide emulsion layer further lower in sensitivity than that of the intermediate layer so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity as described in JP-A No. 202464/1984. As stated above, various layer constitutions and arrangements can be selected in accordance with the purpose of the particular photosensitive material.

The dried film thickness of total constitutional layers, excluding the support and the undercoat layer and the backing layer of the support of a photosensitive material, is preferably 12.0 to 20.0 $\mu$m, more preferably 12.0 to 17.0 $\mu$m, in view of bleaching fog and aging stain.

The film thickness of photosensitive material is determined as follows:

The photosensitive material to be measured is stored for 7 days at 25° C. and 50% RH after preparation of the photosensitive material. Then the total thickness of the photosensitive material and the thickness remained after removing total coating layers on the support are measured. The difference of the above two thicknesses is the film thickness of total coating layers excluding the support. The thickness can be measured, for example, by a film thickness gauge provided a piezoelecric-crystal element (e.g., K-402B Stand., manufactured by Anritsu Electric Co., Ltd.). The removing of coating film layers can be done using an aqueous sodium hypochloride solution. Further, the total thickness of the photosensitive material on the support can be determined by a cross section photograph of the above photosensitive material utilizing a scanning electron microscope (preferably the magnifying power is 3,000 or more).

In the present invention, the swelling ratio of the photosensitive material represented by the formula of [(Swelled film thickness equilibrated in water at 20° C. -total film thickness dried at 25° C. and 55% RH)/total film thickness dried at 25° C. and 55% RH]×100 is preferably 50 to 200%, more preferably 70 to 150%. When the swelling ratio is out of the above-mentioned range, the residual amount of color developing agent increases, and photographic properties, image quality such as desilvering property, and film properties such as film strength may be affected.

Preferably the film swelling speed $T_{1/2}$ of the photosensitive material in the present invention is 15 sec or below, more preferably 9 sec or below. Herein the swelling speed $T_{1/2}$ is defined as the time required to reach a film thickness of ½ of the saturated film thickness that is 90% of the maximum swelled film thickness that will be reached when the film is treated with a color developer at 38° C. for 3 min 15 sec.

The silver halide to be contained in the photographic emulsion layer of the photosensitive material utilized in the present invention may be any of silver iodobromide, silver iodochlorobromide, silver chlorobromide, silver bromide, and silver chloride. A preferable silver halide is silver iodobromide, silver iodochloride, and silver iodochlorobromide, containing about 0.1 to 30 mol % silver iodide. A particularly preferable silver halide is a silver iodobromide containing about 2 to about 25 mol % of silver iodide.

The silver halide grains in the photographic emulsion may have a regular crystal form, such as a cubic shape, an octahedral shape, and a tetradecahedral shape, or a irregular crystal shape, such as spherical shape or a tabular shape, or they may have a crystal defect, such as twin planes, or they may have a composite crystal form.

The silver halide grains may be fine grains having a diameter of about 0.2 μm or less, or large-size grains with the diameter of the projected area being down to about 10 μm. As the silver halide emulsion, a polydisperse emulsion or a monodisperse emulsion can be used.

The silver halide photographic emulsions that can be used in the present invention may be prepared suitably by known means, for example, by the methods described in I. Emulsion Preparation and Tvwes, in *Research Disclosure* (RD) No. 17643 (December 1978), pp. 22–23, and ibid. No. 18716 (November 1979), p. 648, and ibid. No. 307105 (November, 1989), pp. 863–865; the methods described in P. Glafkides, *Chimie et Phisigue Photographigue*, Paul Montel (1967), in G. F. Duffin, *Photographic Emulsion Chemistry*, Focal Press (1966), and in V. L. Zelikman et al., *Making and Coating of Photographic Emulsion*, Focal Press (1964).

A monodisperse emulsion, such as described in U.S. Pat. Nos. 3,574,628 and 3,655,394, and in British Patent No. 1,413,748, is also preferable. A tabular grain having a aspect ratio of about 5 or more can be used in the present invention. Tabular grains can be prepared by a method described in, for example, Gutoff, *Photographic Science and Engineering*, Vol. 14, pp.248–257 (1970), U.S. Pat. Nos. 4,434,226, 4,414,310, 4,430,048, and 4,439,520, and British Patent No. 2,112,157.

The crystal structure of silver halide grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Mixture of grains having various crystal form may also be used.

The silver halide emulsion that has been physically ripened, chemically ripened, and spectrally sensitized is generally used. Additives to be used in these steps are described in *Research Disclosure* Nos. 17643 (December, 1978), 18716 (November, 1979), and 307105 (November, 1989), and involved sections are listed in the Table shown below.

Known photographic additives that can be used in the present invention are also described in the above-mentioned three Research Disclosures, and involved sections are listed in the same Table below.

| | Additive | RD 17643 | RD 18716 | RD 307105 |
|---|---|---|---|---|
| 1 | Chemical sensitizer | p. 23 | p. 648 (right column) | p. 866 |
| 2 | Sensitivity-enhancing agent | — | p. 648 (right column) | — |
| 3 | Spectral sensitizers and Supersensitizers | pp. 23–24 | pp. 648 (right column)–649 (right column) | pp. 866–868 |
| 4 | Brightening agents | p. 24 | p. 647 (right column) | p. 868 |
| 5 | Antifogging agents and Stabilizers | pp. 24–25 | p. 649 (right column) | pp. 868–870 |
| 6 | Light absorbers, Filter dyes, and UV Absorbers | pp. 25–26 | pp. 649 (right column)–650 (left column) | p. 873 |
| 7 | Stain-preventing agent | p. 25 (right column) | p. 650 (left to right column) | p. 872 |
| 8 | Image dye stabilizers | p. 25 | p. 650 (left column) | p. 872 |
| 9 | Hardeners | p. 26 | p. 651 (left column) | pp. 874–875 |
| 10 | Binders | p. 26 | p. 651 (left column) | pp. 873–874 |
| 11 | Plasticizers and Lubricants | p. 27 | p. 650 (right column) | p. 876 |
| 12 | Coating aids and Surface-active agents | pp. 26–27 | p. 650 (right column) | pp. 875–876 |

-continued

| | Additive | RD 17643 | RD 18716 | RD 307105 |
|---|---|---|---|---|
| 13 | Antistatic agents | p. 27 | p. 650 (right column) | pp. 876–877 |
| 14 | Matting agent | — | — | pp. 878–879 |

In the present invention, various color couplers can be used in a combined use, and representative examples thereof are those as described in patents in the above-mentioned RD Nos. 17643, VII -C-G and 307105, VII -C-G.

As yellow couplers, those described in, for example, U.S. Pat. Nos. 3,933,501, 4,022,620, 4,326,024, 4,401,752, and 4,248,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

As magenta couplers, 2-equivalent and/or 4-equivalent 5-pyrazolone-series compounds and pyrazoloazole-series compounds are preferable, and couplers described in, for example, U.S. Pat. Nos. 4,310,619 and 4,351,897, European Patent No. 73,636, U.S. Pat. Nos. 3,061,432 and 3,725,067, *Research Disclosure* No. 24220 (June 1984), JP-A No. 33552/1985, *Research Disclosure* No. 24230 (June 1984), JP-A Nos. 43659/1985, 72238/1986, 35730/1985, 118034/1980, and 185951/1985, U.S. Pat. Nos. 4,500,630, 4,540,654 and 4,556,630, and WO(PCT) No. 88/04795 are preferable, in particular.

As cyan couplers, phenol-series couplers and naphthol-series couplers can be mentioned, and those described, for example in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,753,871, 4,451,559, 4,427,767, 4,690,889, 4,254,212, and 4,296,199, and JP-A No. 42658/1986 are preferable.

As a colored coupler to rectify the unnecessary absorption of color-forming dyes, those couplers described in, paragraph VII-G of *Research Disclosure* No. 17643, paragraph VII-G of ibid. No. 307105, U.S. Pat. No. 4,163,670, JP-B No. 39413/1982, U.S. Pat. Nos. 4,004,929 and 4,138,258, British Patent No. 1,146,368, and JP-A No. 251843/1991 are preferable. Further, it is preferable to use couplers to rectify the unnecessary absorption of color-forming dyes by a fluorescent dye released upon the coupling reaction as described in U.S. Pat. No. 4,774,181 and couplers having a dye precursor, as a group capable of being released, that can react with the developing agent to form a dye as described in U.S. Pat. No. 4,777,120.

As a coupler which forms a dye having moderate diffusibility, those described in U.S. Pat. No. 4,366,237, British Patent No. 2,125,570, European Patent No. 96,570, and West German Patent Application (OLS) No. 3,234,533 are preferable.

Typical examples of polymerized dye-forming coupler are described in, for example, U.S. Pat. Nos. 3,451,820, 4,080,211, 4,367,282, 4,409,320, and 4,576,910, and British Patent No. 2,102,173.

A compound that releases a photographically useful residue accompanied with the coupling reaction can be used favorably in this invention. As a coupler that releases, imagewisely, a nucleating agent or a development accelerator upon developing, those described in British Patent Nos. 2,097,140 and 2,131,188, and JP-A Nos. 157638/1984 and 170840/1984 are preferable.

Other compounds that can be incorporated in the photographic material of the present invention include competitive couplers described in U.S. Pat. No. 4,130,427, couplers which release a dye to regain a color after releasing as described in European Patent Nos. 173,302A and 313,308A, couplers which release a bleaching accelerator as described in RD Nos. 11449 and 24241, and JP-A No. 201247/1986, couplers which release a ligand as described in U.S. Pat. No. 4,553,477, couplers which release a leuco dye as described in JP-A No. 75747/1988, and couplers which release a fluorescent dye as described in U.S. Pat. No. 4,774,181.

Couplers utilized in the present invention can be incorporated into a photographic material by various known dispersion methods.

Examples of high-boiling solvent for use in oil-in-water dispersion process are described in, for example, U.S. Pat. No. 2,322,027, and as specific examples of high-boiling organic solvent having a boiling point of 175° C. or over at atmospheric pressure for use in oil-in-water dispersion process can be mentioned phthalates [e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl)-phthalate]; esters of phosphoric acid or phosphonic acid (e.g., triphenyl phosphate, tricrezyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate); benzoic esters (e.g., 2-ethylhexyl benzoate, dodecyl benzoate, and 2-ethylhexyl-p-hydroxy benzoate); amides (e.g., N,N-diethyldodecanamide, N,N-diethyllaurylamide, and N-tetradecylpyrrolidone); alcohols or phenols (e.g., isostearyl alcohol and 2,4-di-t-amyl phenol); aliphatic carbonic acid esters (e.g., bis(2-ethylhexyl) sebacate, dioctyl azelate, glycerol tributylate, isostearyl lactate, and trioctyl citrate); aniline derivatives (e.g., N,N-dibutyl-2-butoxy-5-t-octylaniline); and hydrocarbons (e.g., paraffin, dodecyl benzene, and diisopropyl naphthalene). Further, as a co-solvent an organic solvent having a boiling point of about 30° C. or over, preferably a boiling point in the range from 50° C. to about 160° C. can be used, and as typical example can be mentioned ethyl acetate, butyl acetate, ethyl propionate, methylethyl ketone, cyclohexanone, 2-ethoxyethyl acetate, and dimethyl formamide.

Specific examples of process and effects of latex dispersion method, and latices for impregnation are described in, for example, U.S. Pat. No. 4,199,363 and West German Patent Application (OLS) Nos. 2,541,274 and 2,541,230.

These couplers can also be emulsified and dispersed into an aqueous hydrophilic colloid solution by impregnating them into a loadable latex polymer (e.g., U.S. Pat. No. 4,203,716) in the presence or absence of the-above-mentioned high-boiling organic solvent, or by dissolving them in a polymer insoluble in water and soluble in organic solvents. Preferably, homopolymers and copolymers described in International Publication Patent No. WO 88/00723. pp. 12 to 30, are used. Particularly, the use of acrylamide-series polymers is preferable because, for example, dye images are stabilized.

The case wherein the present invention is utilized in the treatment for silver halide black-and-white photosensitive material is described below.

In the developer for use in the development processing of silver halide black-and-white photosensitive material, additives usually used (e.g., a developing agent, an alkaline agent, a pH-buffer, a preservative, and a chelating agent) can be contained. In the processing according to the present invention, any known method can be used, and any known processing solution can be used. Although the processing temperature is selected generally from the range of 18° to 50° C., it may be the temperature lower than 18° C. or the temperature higher than 50° C. In the black-and-white developer, known developing agent, such as dihydroxybenzenes, 1-phenyl-3-pyrazolidones, and aminophenols, is used alone or in combination thereof.

As a dihydroxybenzene-series developing agent can be mentioned, for example, hydroquinone, chlorohydroquinone, bromohydroquinone, isopropylhydroquinone, methylhydroquinone, 2,3-dichlorohydroquinone, 2,3-dibromo-hydroquinone, and 2,5-dimethylhydroquinone. Among them, hydroquinone is particularly preferable. Examples of 1-phenol-3-pyrazolidone or derivatives thereof, as assistant developing agent, include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxy-methyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

As p-amionphenol-series assistant developing agent can be mentioned N-methyl-p-aminophenol, p-aminophenol, N-(β-hydroxyethyl)-p-aminophenol, N-(4-hydroxyphenyl) glycin, 2-methyl-p-aminophenol, and p-benzylaminophenol. Among them, N-methyl-p-aminophenol is preferable. Preferably dihydroxybenzene-series developing agent is used in an amount of 0.05 to 0.8 mol/liter. When a dihydroxybenzene and a 1-phenyl-3-pyrazolidone or a p-aminophenol are used in combination, preferably, the former is used in an amount of 0.05 to 0.5 mol/liter, and the later is used in an amount of 0.06 mol/liter or less.

As sulfite-preservatives can be mentioned sodium sulfite, potassium sulfite, lithium sulfite, sodium hydrogensulfite, potassium methahydrogensulfite, and sodium formaldehydehydrogensulfite.

In a black-and-white developer, particularly in a developer of graphic arts, sulfite is used in an amount of 0.3 mol/liter or more. Preferably the upper limit of sulfite is 1.2 mol/liter or less, because excess addition causes precipitate in the developer, resulting solution contamination.

Examples of alkaline agent for use in the developer of the present invention include pH-adjusting agents and buffers, such as sodium hydroxide, potassium hydroxide, sodium carbonate, potassium carbonate, sodium tertiary phosphate, potassium tertiary phosphate, sodium silicate, and potassium silicate.

As additives that can be used besides the above-mentioned elements, can be mentioned a development restrainer, such as compounds including boric acid and borax, sodium bromide, potassium bromide, and potassium iodide; an organic solvent, such as ethylene glycol, diethylene glycol, triethylene glycol, dimethylformamide, methyl cellosolve, hexylene glycol, ethanol, and methanol; an antifogging agent or black pepper-preventing agent, such as mercapto compounds including 1-phenyl-5-mercaptotetrazole and sodium 2-mercaptobenzimidazole-5-sulfonate, indazole compounds including 5-nitroindazole, benztriazole compounds including 5-methylbenztriazole. Further, a tone-conditioning agent, a surface-active agent, an antiformer, an water softener, or a film-hardening agent can be contained according to needs.

In the developer for use in the present invention, compound as a silver contamination-preventing agent described, for example in JP-A No. 24347/1981; compound as a developer streaks-preventing agent described, for example in JP-A No. 212651/1987; and compound as a assistant solvent described, for example in JP-A No. 267759/1986 can be used. In the developer for use in the present invention, boric acid as a buffer described, for example in JP-A No. 186259/1987, and saccharides (e.g., sucrose) described, for example in JP-A No. 93433/1985, oximes (e.g., acetoxime), phenols (e.g., 5-sulfosalicilic acid), and tertiary phosphate (e.g., sodium salt and potassium salt) can be used.

The fixing solution is an aqueous solution containing, besides a fixing agent, a hardening agent (e.g., an water soluble aluminum compound), acetic acid and a dibasic acid (e.g., tartaric acid and citric acid or salts thereof), if needed. The pH of the fixing solution is preferably 3.8 or higher, more preferably 4.0 to 7.5. The water soluble ammonium salt that acts as mainly hardening agent is a known compound as a hardening agent in acidic hardening-fixing-solution, and examples thereof include, for example aluminum chloride, aluminum sulfate, and potassium alum. As the above-mentioned dibasic acid, tartaric acid (including its sodium salt and its potassium salt) or its derivatives, or citric acid (including its sodium salt and its potassium salt) or its derivatives can be used alone or in combination of two or more thereof. Effectively these compounds are contained in an amount of 0.005 mol or more, more preferably 0.01 to 0.03 mol, per liter of the fixing solution.

The fixing solution can contain, if necessary, a pH-buffer (e.g., acetic acid and boric acid), a pH-adjusting agent (e.g., ammonia and sulfuric acid), an image-storageability-improving agent (e.g., potassium iodide), or a chelating agent. Herein, the pH-adjusting agent is preferably used in an amount of 10 to 40 g per liter, more preferably 18 to 25 g per liter, because the pH of developer is in a higher range. The temperature and time of fixing process are the same as those of developing, for example, about 20° to about 50° C. and 10 sec to 1 min are preferable, respectively.

To details other than the above-described of the fixing solution are applied the description of the fixing solution for use in the color photographic material above described. Further, the washing water can contain a mildew-proofing agent (e.g., compound described in Horiguchi, *Bokin Bobaizai no Kagaku* or JP-A No. 115154/1987), washing accelerator (e.g., sulfite), and chelating agent. The replenishment rate of washing water may be 1,200 ml/m$^2$ or less (including 0). The terms "the replenishment rate of washing water (or stabilizing solution) is 0" means an washing method of so-called accumulated water washing method. As low-replenishment-rate method multistage (e.g., 2-stage and 3-stage) counter-current system is known already.

For problems which occur in the case of low-replenishment-rate of water such as washing water, good processing properties can be attained by utilizing the combination of the techniques described in the processing of color photosensitive material.

When washing is carried out by a small amount of water in the present invention, more preferably a squeeze roller or crossover rack washing tank is provided as described in, for example, JP-A Nos. 18350/1988 and 287252/1987. Further, a part or all of overflow solution from washing or stabilizing bath generated by replenishing of mildew-proofed water according to needs can be utilized in the preceding bath having fixing capacity, as described in, for example, JP-A Nos. 235133/1985 and 129343/1988. Further, an water soluble surface-active agent or antifoamer can be added to prevent occurrence of water spots that is liable to occur when washing is carried out by using a small amount of water, and/or transferring of processing agents adhered on a squeeze roller to the film processed. The dye-absorbing agent as described in, for example JP-A No. 163456/1988 may be provided in the washing bath for prevention of contamination due to dyes dissolved from the photosensitive material.

According to the above-described method, the developed and fixed photographic material is washed and dried. The washing is conducted in order to almost perfectly remove silver salts dissolved by fixing process, and preferably conducted at about 20° to about 50° C. for 10 sec to 3 min. Drying is conducted at about 40° to about 100° C., wherein the drying time may be suitably changed according to the condition of atmosphere, but it may be generally 5 sec to 3 min and 30 sec.

A roller carrying-type automatic processor is described in, for example, U.S. Pat. Nos. 3,025,779 and 3,545,971, and in the present specification it is referred to as the roller carrying-type processor. The roller carrying-type processor is constituted of 4 steps, that is, developing, fixing, washing, and drying, and the method according to the present invention most preferably follows to these 4 steps, even not excluding some other steps (e.g., stopping process). Herein, an water-saving treatment may be carried out by an washing process of 2 to 3 steps countercurrent washing mode.

The fixing solution of the present invention and the developer for use in the present invention are preferably stored using the packaging material having a low air permeability as described in, for example JP-A No. 73147/1986. Further, processing solutions for use in the present invention preferably utilizes the replenishing system described in, for example JP-A No. 91939/1987.

As the photographic material according to the present invention can be mentioned, for example, an usual black-and-white silver halide photographic material (e.g., a black-and-white photographic material for photographing, a black-and-white photographic material for X-ray photographing, and a black-and-white photographic material for printing), an usual multilayer silver halide color photographic material (e.g., a color negative film, a color reversal film, a color positive film, a color negative film for movie, a color printing paper, a reversal color printing paper, and a direct positive color printing paper), an infrared-sensitive photographic material for laser scanning.

The thickness of support of color negative film for use in the present invention is preferably 70 to 130 $\mu$m. As the raw material various plastics film as described in, for example, JP-A. No. 124636/1992, p. 5, right upper column line 1 to p.6, right upper column line 5, can be used, and as preferable ones can be mentioned a cellulose derivative (e.g., diacetyl-, triacetyl-, propionyl-, butanoyl-, and acetylpropionyl-acetate), and a polyester described in, for example JP-B No. 40414/1973 (e.g., polyethylene terephthalate, poly-1,4-cyclohexanedimethylene terephthalate, and polyethylene naphthalate). Preferably a polyester film is used as a film support for the present invention, because a higher water draining effect can be attained.

Preferably the support of the color negative film for use in the present invention is one comprising a layer having conductivity and a transparent magnetic material layer on one side, as described in JP-A No. 62543/1993; one comprising a magnetic recording layer, as described in, for example, International Publication Patent No. WO90/04205, FIG. 1A; and one comprising a stripe magnetic recording layer and a transparent magnetic recording layer adjacent to the stripe magnetic recording layer, as described in, for example, JP-A No. 124628/1992. On these magnetic recording layers, preferably a protective layer is provided, as described in, for example, JP-A No. 73737/1992.

Although a package (patrone or magazine) receiving the color negative film of the present invention may be any of presently used types and known ones, in particular, one having a shape described in U.S. Pat. No. 4,834,306, FIGS. 1 to 3, or U.S. Pat. No. 4,846,418, FIGS. 1 to 3, is preferable.

When the compound represented by formula (I) of the present invention was used in combination with another fixing agent, such as thiosulfate ion, in a bath having fixing capacity; a washing bath; and/or a stabilizing bath, it has been proved that preferable effects of the fixing property being improved, and also the stability of the solution being improved, compared with the case of a fixing process using a conventional fixing agent, can be attained.

Next, the present invention will be described in detail in accordance with examples, but the invention is not limited to them.

Example 1

A color negative film (Sample 101) described in Example 1 of JP-A No. 303186/1993 was prepared and cut into strips of 35 mm width. The strip was subjected, after an imagewise exposure, to a running processing using an automatic processor. Each running processing was carried out continuously on a 200-meter-length strip of 35 mm width.

The processing steps and composition of each processing solution are shown below.

| Processing | Processing | | Reple- | Tank |
|---|---|---|---|---|
| step | time | temperature | nisher* | Volume |
| Color developing | 3 min 5 sec | 38.0° C. | 550 ml | 5 liter |
| Bleaching | 30 sec | 38.0° C. | 130 ml | 3 liter |
| Fixing (1) | 30 sec | 38.0° C. | — | 3 liter |
| Fixing (2) | 30 sec | 38.0° C. | 200 ml | 3 liter |
| Washing | 20 sec | 38.0° C. | 400 ml | 2 liter |
| Stabilizing (1) | 20 sec | 38.0° C. | — | 2 liter |
| Stabilizing (2) | 20 sec | 38.0° C. | 400 ml | 2 liter |
| Drying | 60 sec | 55° C. | | |

Note:
*Replenisher amount per $m^2$ of photographic material.

Fixing and stabilizing were carried out in a countercurrent mode from tank (2) to tank (1), respectively. Overflow solutions from washing were all introduced into the fixing (2) step. The carried over amount of developer to the bleaching step, the carried over amount of bleaching solution to the fixing step, and the carried over amount of fixing solution to the washing step, were respectively 65 ml, 50 ml, and 50 ml, per $m^2$ of the photographic material. Each crossover time was 5 sec and is included in the processing time of the preceding step.

The composition of each processing solution was as follows, respectively:

| | Tank Solution (g) | Replenisher (g) |
|---|---|---|
| (Color-developer) | | |
| Diethylenetriaminepentaacetic acid | 2.0 | 2.2 |
| Disodium catecol-3,5-disulfonate | 0.3 | 0.3 |
| Disodium N,N-bis(2-sulfoethyl)-hydroxylamine | 2.0 | 2.0 |
| Sodium sulfite | 3.9 | 5.2 |
| Potassium carbonate | 37.5 | 39.0 |
| Potassium bromide | 1.4 | — |
| Potassium iodide | 1.3 mg | — |
| Hydroxylamine sulfate | 2.4 | 3.3 |
| 2-Methyl-4-[N-ethyl-N-(β-hydroxyethyl)-amino]aniline sulfonate | 4.5 | 6.3 |
| Water to make | 1.0 liter | 1.0 liter |
| pH | 10.05 | 10.16 |
| (Bleaching solution) | | |
| Iron (III) ammonium 1,3-diaminopropane-tetraacetate monohydrate | 132.0 | 180.0 |
| Maleic acid | 40 | 60 |
| Succinic acid | 20 | 30 |
| Ammonium bromide | 84.0 | 120.0 |
| Ammonium nitrate | 17.5 | 25.0 |
| Water to make | 1.0 liter | 1.0 liter |
| pH | 4.50 | 4.00 |
| (pH was adjusted by aqueous ammonia) | | |
| (Fixing solution) Tank solution | | |
| (Replenisher: 3 times concentrated solution of Tank solution) | | |
| Aqueous ammonium thiosulfate solution (700 g/liter) | 280 ml | |
| Additive (stabilizing agent) | See Table 1 | |
| Imidazole | 15.0 | |
| Ethylenediaminetetraacetic acid | 12.5 | |
| Water to make | 1.0 liter | |
| pH | 7.40 | |
| (pH was adjusted by aqueous ammonia and acetic acid) | | |

(Washing water)

(Both tank solution and replenisher)

Tap water was treated by passage through a mixed bed ion-exchange column filled with H-type strong acidic cation exchange resin (Amberlite IR-120B, tradename, made by Rohm & Haas) and OH-type strong basic anion exchange resin (Amberlite IRA-400, the same as the above) so that the concentrations of Ca ions and Mg ions in water were both made to decrease to below 3 ml/liter, followed by adding 20 mg/liter of sodium dichlorinated isocyanurate and 150 mg/liter of sodium sulfate. The pH of this water was in the range of 6.5 to 7.5.

(Stabilizing solution)
(Both tank solution and replenisher)

| | (g) |
|---|---|
| 1,4-Bis(1,2,4-triazole-1-yl-methyl) piperazine | 0.6 |
| 1,2,4-Triazole | 1.3 |
| Polyoxyethylene-p-monononylphenylether (av. polymerization degree: 10) | 0.2 |
| Sodium p-toluenesulfinate | 0.05 |
| 1,2-benzoisothiazoline-3-one | 0.01 |
| Gentamycin | 0.01 |
| Water to make | 1.0 liter |
| pH | 8.0 |

After completion of the above running processing, the unexposed Sample 101 was processed, and the residual silver was determined by a fluorescent X-ray analysis.

Further, 300 ml of each tank solution of fixing (1) after the running processing was put into a tall 300-ml beaker, and this was stored at 40° C., to examine how many days it took for sulfur deposit to occur in the solution.

Results are shown in Table 1.

TABLE 1

| No. | Additive: Compound No. | Additive: Added amount (mol/l) | Residual Silver ($\mu g/cm^2$) | Days until sulfur deposit occurred | Remarks |
|---|---|---|---|---|---|
| 1 | — | — | 20 | 2 | Comparison |
| 2 | A* | 0.2 | 25 | 11 | " |
| 3 | B** | 0.2 | 28 | 10 | " |
| 4 | C*** | 0.2 | 35 | 5 | " |
| 5 | 1 | 0.01 | 16 | 12 | This Invention |
| 6 | 1 | 0.05 | 10 | 30 | " |
| 7 | 1 | 0.2 | 5 | over 40 | " |
| 8 | 1 | 0.5 | 6 | " | " |
| 9 | 1 | 1.0 | 15 | " | " |
| 10 | 4 | 0.2 | 7 | " | " |
| 11 | 5 | 0.2 | 6 | " | " |
| 12 | 10 | 0.2 | 8 | " | " |

Note:
*Comparative compound A = Ammonium p-toluene-sulfinic acid
**Comparative compound B = Ammonium n-hexane-sulfinic acid
***Comparative compound C = Ammonium sulfite As is apparent from the results shown in Table 1, compound represented by formula (I) of the present invention not only remarkably improves the stability of the fixing solution, it is also excellent in the fixing property.

Example 2

A color photographic printing paper (Sample 001) described in Example 4 of JP-A No. 303186/1993 was prepared and converted to 127 mm-width rolls. Each roll was subjected to an imagewise exposure and then a continuous processing (running test) according to the processing steps shown below, until the accumulated replenisher of the color developer had reached 2 times the volume of the tank, using a Printer Processor PP1250V (manufactured by Fuji Photo Film KK.)(remodeled so that the bleach-fix processing time would be 25 sec).

| Processing step | Temperature | Time | Replenisher* |
|---|---|---|---|
| Color developing | 38.5° C. | 45 sec | 73 ml |
| Bleach-fix | 35° C. | 25 sec | 60 ml** |
| Rinse (1) | 35° C. | 30 sec | — |
| Rinse (2) | 35° C. | 30 sec | — |
| Rinse (3) | 35° C. | 30 sec | 360 ml |
| Drying | 80° C. | 60 sec | |

Note:
*Replenisher amount per $m^2$ of photosensitive material
**In addition to the above-described 60 ml, 120 ml per $m^2$ of photographic material from rinse (1) was introduced.
(Rinsing was carried out in 3-tank countercurrent mode from the tank of rinse (3) to the tank of rinse (1).)

The composition of each processing solution was as follows:

| | Tank Solution | Replenisher |
|---|---|---|
| (Color-developer) | | |
| Water | 800 ml | 800 ml |
| Ethylenetriaminetetraacetic acid | 3.0 g | 3.0 g |

-continued

| | Tank Solution | Reple-nisher |
|---|---|---|
| Disodium 4,5-dihydroxybenzene-1,3-disulphonic acid | 0.5 g 72 | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightening agent (UVITEX-CK, manufactured by Ciba Geigy AG.) | 1.0 g | 3.0 g |
| Sodium sulfite | 0.1 g | 0.1 g |
| Disodium-N,N-bis(sulfonatoethyl)-hydroxylamine | 5.0 g | 10.0 g |
| Sodium triisopropylnaphthalene (β) sulfonate | 0.1 g | 0.1 g |
| N-Ethyl-N-(β-methanesulfonamidoethyl)-3-methyl-4-aminoaniline 3/2 · sulfonate monnohydrate | 5.0 g | 11.5 g |
| Water to make | 1,000 ml | 1,000 ml |
| pH (25° C., adjusted by potassium hydroxide and sulfuric acid) | 10.00 | 11.00 |
| (Bleach-fix solution) | | |
| Water | 600 ml | 150 ml |
| Sodium thiosulfate | 47 g | 120 g |
| Additive | (Table 2) | (2.5 times tank sol'n) |
| Iron (III) sodium ethylenediamine tetraacetate | 55 g | 135 g |
| Ethylenediaminetetraacetic acid | 5 g | 12.5 g |
| Nitric acid (67%) | 30 g | 65 g |
| Water to make | 1,000 ml | 1,000 ml |
| pH (25° C., adjusted by acetic acid and NaOH) | 5.8 | 5.6 |
| (Rinse solution) (Both tank solution and replenisher) | | |
| Sodium chlorinated isocyanurate | 0.02 g | |
| Deionized water (conductivity: 5 μs/cm or below) | 1,000 ml | |
| pH | 6.5 | |

The stability of each bleach-fix solution after the running test was evaluated in the same manner as in Example 1.

Results are shown in Table 2.

TABLE 2

| No. | Additive Compound No. | Additive Added amount (mol/l) | Days until sulfur-deposit occurred | Remarks |
|---|---|---|---|---|
| 1 | — | — | 1 | Comparison |
| 2 | A* | 0.1 | 5 | " |
| 3 | B* | 0.1 | 5 | " |
| 4 | C* | 0.1 | 3 | " |
| 5 | 1 | 0.1 | 26 | This Invention |
| 6 | 2 | 0.1 | 30 | " |
| 7 | 2 and A | 0.05 + 0.05 | over 40 | " |

Note:
*Compounds A, B, and C were the same as in Example 1.

In the bleach-fix solution, the stability of the solution was also improved greatly according to the present invention.

Further, it is understood that the combined use of a compound represented by formula (I) of the present invention and a p-toluenesulfinic acid (Compound A) (No. 7) provided particularly excellent results.

Example 3

Black-and-white photographic materials A and B described in Example 7 of JP-A No. 313281/1993 were prepared, and they were subjected to the running processing of processing (1) described in the same Example.

With respect to the fixing solution to be used in this processing, the effect of the compound represented by formula (I) of the present invention was studied in the same manner as in Example 1 of this specification, and the same effect as in Example 1 was identified on both the fixing property and the stability of the solution.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for processing a silver halide photographic material, wherein, after a silver halide photographic material having at least one photosensitive silver halide emulsion layer on a support is exposed to light, the silver halide photographic material is subjected to development processing, which comprises processing in a bath having fixing capacity which contains at least one compound represented by the following formula (I):

$$RSO_2M$$

wherein R represents a methyl group or an ethyl group, and M represents a hydrogen atom, an alkali metal ion, or an ammonium group, wherein the bath having fixing capacity contains at least one compound represented by formula (I) in an amount of from $1\times10^{-3}$ mol/liter to 5 mol/liter.

2. A method for processing a silver halide photographic material, wherein, after a silver halide photographic material having at least one photosensitive silver halide emulsion layer on a support is exposed to light, the silver halide photographic material is subjected to development processing, which comprises processing in a bath having fixing capacity consisting essentially of:

at least one compound represented by the following formula (I):

$$RSO_2M$$

wherein R represents a methyl group or an ethyl group, and M represents a hydrogen atom or a cationic group, a fixing agent, a chelating agent and optionally a preservative, a fluorescent brightening agent, an anti-foaming agent, a surface-active agent, polyvinyl pyrrolidone, an organic solvent, a bleaching agent, an acid, an alkaline chemical, a bleaching accelerator, a rehalogenizing agent and a metal corrosion inhibitor, wherein the bath having fixing capacity contains at least one compound represented by formula (I) in an amount of from $1\times10^{-3}$ mol/liter to 5 mol/liter.

3. The method for processing a silver halide photographic material as claimed in claim 2, wherein M in formula (I) is selected from the group consisting of a hydrogen atom, an alkali metal ion, an alkali earth metal ion, an ammonium group, and a guanidinium group.

4. The method for processing a silver halide photographic material as claimed in claim 2, wherein R in formula (I) represents a methyl group, and M in formula (I) represents a sodium ion, a potassium ion, or an unsubstituted ammonium group.

5. The method for processing a silver halide photographic material as claimed in claim 2, wherein the cationic group is a sodium ion, a potassium ion, a lithium ion, a cesium ion, a calcium ion, a magnesium ion, an unsubstituted ammonium or methylammonium.

6. The method for processing a silver halide photographic material as claimed in claim 2, wherein said bath having fixing capacity consists essentially of at least one compound represented by formula (I), a fixing agent, an alkaline chemical and a chelating agent.

7. The method for processing a silver halide photographic material as claimed in claim 2, wherein said bath having fixing capacity consists essentially of at least one compound represented by formula (I), a fixing agent, a bleaching agent, and a chelating agent.

8. The method for processing a silver halide photographic material as claimed in claim 2, wherein R is a substituted methyl group or a substituted ethyl group, and the maximum number of carbon atoms in said substituted groups is three.

9. The method for processing a silver halide photographic material as claimed in claim 2, wherein said bath having fixing capacity consists essentially of at least one compound represented by formula (I), a chelating agent, and a fixing agent.

10. A method for processing a silver halide photographic material, wherein, after a silver halide photographic material having at least one photosensitive silver halide emulsion layer on a support is exposed to light, the silver halide photographic material is subjected to development processing, which comprises processing in a bath having fixing capacity consisting essentially of:

at least one compound represented by the following formula (I):

$$RSO_2M$$

wherein R represents a lower alkyl group having 1 to 3 carbon atoms, and M represents a hydrogen atom or a cationic group, a fixing agent, a chelating agent and optionally a preservative, a fluorescent brightening agent, an anti-foaming agent, a surface-active agent, polyvinyl pyrrolidone, an organic solvent, a bleaching agent, an acid, an alkaline chemical, a bleaching accelerator, a rehalogenizing agent and a metal corrosion inhibitor, wherein the bath having fixing capacity contains at least one compound represented by formula (I) in an amount of from $1\times10^{-3}$ mol/liter to 5 mol/liter.

11. The method for processing a silver halide photographic material as claimed in claim 10, wherein R is a substituted methyl group or a substituted ethyl group, and the maximum number of carbon atoms in said substituted groups is three.

12. A method for processing a silver halide photographic material, wherein, after a silver halide photographic material having at least one photosensitive silver halide emulsion layer on a support is exposed to light, the silver halide photographic material is subjected to development processing, which comprises processing in a bath having fixing capacity which contains at least one compound represented by the following formula (I):

$$RSO_2M$$

wherein R represents a substituted or unsubstituted lower alkyl group having 1 to 3 carbon atoms, and M represents a hydrogen atom, an alkali metal ion, or an ammonium group, wherein said bath does not contain a compound of formula (A) (B), (C), or (D)

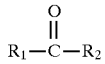

(A)

wherein $R_1$ represents a hydrogen atom, a substituted or unsubstituted alkyl group, a substituted or unsubstituted alkenyl group, a substituted or unsubstituted aralkyl group, a substituted or unsubstituted cycloalkyl group, a substituted or unsubstituted aryl group, a substituted or unsubstituted heterocyclic group, a carboxyl group or a salt thereof, a substituted or unsubstituted ester group, a substituted or unsubstituted acyl group, or a substituted or unsubstituted carbamoyl group; $R_2$ represents a hydrogen atom, a substituted or unsubstituted alkyl group, a substituted or unsubstituted alkenyl group, a substituted or unsubstituted aralkyl group, a substituted or unsubstituted cycloalkyl group, a substituted or unsubstituted aryl group, or a substituted or unsubstituted heterocyclic group; or $R_1$ and $R_2$ can combine to form a ring;

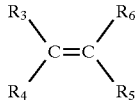

(B)

wherein $R_3$, $R_4$, and $R_5$ each represents a hydrogen atom, a substituted or unsubstituted alkyl group, a substituted or unsubstituted alkenyl group, a substituted or unsubstituted aralkyl group, a substituted or unsubstituted cycloalkyl group, a substituted or unsubstituted aryl group, a substituted or unsubstituted heterocyclic group, a carboxyl group or a salt thereof, a substituted or unsubstituted ester group, a substituted or unsubstituted acyl group, a halogen atom, a substituted or unsubstituted ether group, a sulfo group or a salt thereof, a substituted or unsubstituted sulfinyl group, a substituted or unsubstituted sulfonyl group, a cyano group, a nitro group, a substituted or unsubstituted carbamoyl group, or a substituted or unsubstituted sulfamoyl group; and $R_6$ represents an electron attracting group; or $R_3$ and $R_4$, $R_4$ and $R_5$, $R_5$ and $R_6$, or $R_6$ and $R_3$ can combine to form a ring; with a proviso that when at least one of $R_3$, $R_4$, $R_5$ and $R_6$ is an acyl group, $R_4$ and $R_5$ or $R_6$ and $R_3$ does not form a ring;

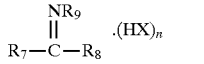

(C)

wherein $R_7$, $R_8$, and $R_9$ each represents a hydrogen atom, a substituted or unsubstituted alkyl group, a substituted or unsubstituted alkenyl group, a substituted or unsubstituted cycloalkyl group, a substituted or unsubstituted aralkyl group, a substituted or unsubstituted aryl group, a substituted or unsubstituted heterocyclic group, a substituted or unsubstituted amino group, a carboxyl group or a salt thereof, a substituted or unsubstituted ester group, a substituted or unsubstituted acyl group, a substituted or unsubstituted ether group, a hydroxyl group, or a substituted or unsubstituted thioether group; X represents an anion; and n represents 0 or 1; or $R_7$ and $R_8$, $R_8$ and $R_9$, or $R_9$ and $R_7$ can combine to form a ring;

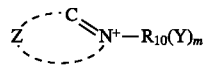

(D)

wherein $R_{10}$ represents a substituted or unsubstituted alkyl group, a substituted or unsubstituted alkenyl group, a substituted or unsubstituted aralkyl group, a substituted or unsubstituted cycloalkyl group, a substituted or unsubstituted aryl group, or a substituted or unsubstituted heterocyclic group; Z represents a heterocyclic group comprising at least one of a carbon atom, a nitrogen atom, an oxygen atom, a sulfur atom or a selenium atom; Y represents an anion; and m represents 0 or 1; or $R_{10}$ can combine with an atom in the Z ring and form a ring, wherein the bath having fixing capacity contains at least one compound represented by formula (I) in an amount of from $1\times10^{-3}$ mol/liter to 5 mol/liter.

13. The method for processing a silver halide photographic material as claimed in claim 12, wherein the bath having fixing capacity contains at least one compound represented by formula (I) in an amount of from $1\times10^{-3}$ mol/liter to 3 mol/liter when said compound is used in combination with a thiosulfate.

14. The method for processing a silver halide photographic material as claimed in claim 12, wherein the bath having fixing capacity contains at least one compound represented by formula (I) in an amount of $1\times10^{-3}$ to 5 mol/liter.

15. The method for processing a silver halide photographic materials as claimed in claim 14, wherein the amount of compound represented by formula (I) is $1\times10^{-2}$ to 3 mol/liter.

16. The method for processing a silver halide photographic material as claimed in claim 14, wherein the amount of compound represented by formula (I) is $1\times10^{-1}$ to 2 mol/liter.

17. The method for processing a silver halide photographic material as claimed in claim 12, wherein the bath having fixing capacity contains thiosulfate ions and further at least one compound represented by formula (I).

18. The method for processing a silver halide photographic material as claimed in claim 12, wherein the bath having fixing capacity contains thiosulfate ions in an amount of 0.1 mol/liter or more and at least one compound represented by formula (I) in an amount of 0.01 mol/liter or more.

19. The method for processing a silver halide photographic material as claimed in claim 12, wherein the bath having fixing capacity contains thiosulfate ions in an amount of 0.1 to 3 mol/liter and at least one compound represented by formula (I) in an amount of 0.01 to 3 mol/liter.

20. The method for processing a silver halide photographic material as claimed in claim 12, wherein the processing is carried out under replenishing of a solution having fixing capacity.

21. The method for processing a silver halide photographic material as claimed in claim 20, wherein the replenishment rate of the solution having fixing capacity is 2,000 ml or less per $m^2$ of photographic material.

22. The method for processing a silver halide photographic material as claimed in claim 20, wherein the replenishment rate of the solution having fixing capacity is 100 to 2,000 ml per $m^2$ of photographic material.

23. The method for processing a silver halide photographic material as claimed in claim 20, wherein the replenishment rate of the solution having fixing capacity is 200 to 800 ml per $m^2$ of photographic material.

24. The method for processing a silver halide photographic material as claimed in claim 12, wherein R is a substituted methyl group or a substituted ethyl group, wherein a substituent on said methyl or ethyl group is selected from the group consisting of a halogen atom, an alkoxy group, an amino group, an acylamino group, a ureido group, a urethane group, a sulfonylamino group, a sulfamoyl group, a carbamoyl group, a sulfonyl group, an alkyloxycarbonyl group, an acyl group, an acyloxy group, a phosphoric acid amido group, an alkylthio group, a cyano group, a sulfo group, a carboxyl group, a mercapto group, a phosphono group, a nitro group and a hydrazino group.

25. The method for processing a silver halide photographic material as claimed in claim 24, wherein R is a substituted methyl group or a substituted ethyl group, wherein a substituent on said methyl or ethyl group is selected from the group consisting of fluroine, chlorine, bromine, methoxy, ethoxy, unsubstituted amino, methylamino, acetylamino, unsubstituted ureido, N-methylureido, methoxycarbonylamino, methylsulfonylamino, unsubstitutedsulfamoyl, N-methylsulfamoyl, unsubstituted carbamoyl, N-methylcarbamoyl, methanesulfonyl, methoxycarbonyl, acetyl, acetoxy, N,N-dimethylphosphoric acid amide, methylthio, and ethylthio.

26. The method for processing a silver halide photographic material as claimed in claim 12, wherein the compound represented by Formula (I) is selected from the group consisting of any one of compounds 1–7 and 12–36:

1. $CH_3SO_2NH_4$
2. $CH_3SO_2Na$
3. $CH_3SO_2K$
4. $CH_3SO_2Li$
5. $C_2H_5SO_2NH_4$
6. $C_2H_5SO_2Na$
7. $C_2H_5SO_2K$
12. $CH_3OCH_2SO_2NH_4$
13. $CH_3OCH_2SO_2Na$
14. $CH_3OCH_2CH_2SO_2Na$
15. $CH_3OCH_2CH_2SO_2NH_4$
16. $HOOCCH_2SO_2H$
17. $NaOOCCH_2SO_2Na$
18. $HOOCCH_2CH_2SO_2K$
19. $H_2NCH_2SO_2H$
20. $H_2NCH_2SO_2NH_4$
21. $CH_3CONHCH_2SO_2NH_4$
22. $CH_3CONHCH_2SO_2Na$
23. $CH_3SO_2NHCH_2SO_2Na$
24. $CH_3SO_2NHCH_2SO_2NH_4$
25. $CH_3SO_2CH_2SO_2Na$
26. $H_2NCOCH_2SO_2NH_4$
27. $H_2NCOCH_2CH_2SO_2Na$
28. $H_2NSO_2CH_2SO_2NH_4$
29. $H_2NSO_2CH_2SO_2Na$
30. $F_3CSO_2Na$
31. $F_3CSO_2NH_4$
32. $F_3CSO_2K$
33. $C_2F_3SO_2NH_4$
34. $ClCH_2CH_2SO_2NH_4$
35. $H_2N\overset{\overset{\displaystyle O}{\|}}{C}NHCH_2SO_2Na$
36. $NCCH_2SO_2Na$.

27. The method for processing a silver halide photographic material as claimed in claim 12, wherein R is a substituted methyl group or a substituted ethyl group, and the maximum number of carbon atoms in said substituted groups is three.

28. The method for processing a silver halide photographic material as claimed in claim 12, wherein R represents a methyl group or an ethyl group.

* * * * *